United States Patent [19]

Rivera

[11] Patent Number: 5,066,008

[45] Date of Patent: Nov. 19, 1991

[54] ELECTRONIC VOICE AND CONTROL SYSTEM FOR BILLIARDS

[76] Inventor: Roberto S. Rivera, Urb. La Margarita Calle B-H-15, Salinas, P.R. 00751

[21] Appl. No.: 504,834

[22] Filed: Apr. 5, 1990

[51] Int. Cl.[5] ..... A63D 15/00; A63D 15/20

[52] U.S. Cl. ..... 273/2; 273/3 R; 273/14; 273/59 A; 273/11 R

[58] Field of Search ..... 273/2, 3 R, 1 ES, 14, 273/11 C, 11 R, 123 A, 125 A, DIG. 26, 59 R, 59 A; 364/411

[56] References Cited

U.S. PATENT DOCUMENTS

| | | | |
|---|---|---|---|
| 1,163,412 | 12/1915 | Jorstad | 273/2 |
| 2,806,701 | 9/1957 | Durant | 273/125 A |
| 4,042,491 | 8/1977 | Hazeltine et al. | 273/14 |
| 4,266,214 | 5/1981 | Peters, Jr. | 364/410 |
| 4,355,802 | 10/1982 | Sargent | 273/11 R |
| 4,516,770 | 5/1985 | Brookes et al. | 273/11 R |
| 4,524,969 | 6/1985 | Erzmoneit | 273/3 R |
| 4,878,664 | 11/1989 | Brookes | 273/3 R |
| 4,948,128 | 8/1990 | Emery, II et al. | 273/14 |
| 5,026,053 | 6/1991 | Paterson et al. | 273/3 R |

FOREIGN PATENT DOCUMENTS

| | | | |
|---|---|---|---|
| 0077605 | 4/1983 | European Pat. Off. | 273/11 R |
| 2592808 | 7/1987 | France | 273/2 |
| 2186491 | 8/1987 | United Kingdom | 273/DIG. 26 |

*Primary Examiner*—Edward M. Coven
*Assistant Examiner*—Jessica J. Harrison
*Attorney, Agent, or Firm*—H. Jay Spiegel

[57] ABSTRACT

The present invention relates to an electronic voice and control system for billiards. The inventive system, intended for use with a standard billiard table having a separate return for the cue ball, includes sensors on each pocket to indicate when a ball has entered a particular pocket. Audio and visual display devices, responsive to various aspects of the game, are included to indicate different events or game related information occurring during playing of the game. Switching means are provided to indicate which player is playing as well as all electric circuitry, including programmable devices, to facilitate the audio and visual display devices being responsive to player and game activity.

7 Claims, 16 Drawing Sheets

L5244
A2
SW2
DATA BUS INPUT
SP1
S8
S7
S6
S5
S4
S3
S2
S1
X1
OSC. CIRCUIT
SP2
SW1
LS244
A1
A9
LS30

74HCT 373
A12
8D
7D
6D
5D
4D
3D
2D
1D
G
CE
8Q
7Q
6Q
5Q
4Q
3Q
2Q
1Q
A11
I0
I1
I2
I3
I4
I5
I6
I7
ST
MD
CS
Reset
Busy
X1
UPD7759
ASD7
ASDO
A8
ΔØ
DRQ
PLE
REF
AVO
27256
A14
A13
A12
A11
A10
A9
A8
A7
A6
A5
A4
A3
A2
A1
A0
D7
D6
D5
D4
D3
D2
D1
D0
CE
OE
SEL 1
LS00

48
38

| FIG. 4 | FIG. 5 | FIG. 6 |
|---|---|---|

| FIG. 7 | FIG. 8 | FIG. 9 |
|---|---|---|

| FIG. 7 | FIG. 8 | FIG. 9 |
|---|---|---|

| FIG. 10 | FIG. 11 |
|---|---|

| FIG. 10 | FIG. 11 |
|---|---|

(A9) One shot circuit
+5v
R9
A9
LS221
77
79
75
A8
LS74
73
Counter input pulse generator circuit : (A5, A7, & A8)
A7
LS04
A5
LS00
(To A2 pin 9 FIG.10)
To A2 pin 12 FIG.10
(To A2 pin 4 FIG.10)
(To A2 pin 7 FIG.10)
R10
J1
Counter reset

| FIG. 13 | FIG. 14 |
|---|---|

A9
LS221
A8
LS74
A7
LS04
A5
LS00
A16
LS00
+5v
83 (A9)
(TO A3 pin 9 FIG. 10)
(TO A3 pin 12 FIG. 10)
(TO A3 pin 4 FIG. 10)
(TO A3 pin 7 sheet 1)
(TO A7 pin 8 FIG. 13)

| FIG. 15 | FIG. 16 |
|---|---|

ELECTRONIC VOICE AND CONTROL SYSTEM FOR BILLIARDS

BACKGROUND OF THE INVENTION

The present invention relates to an electronic voice and control system for billiards. In the prior art, electronic systems associated with a billiard table are known. However, to Applicant's knowledge, no such system is known which includes all of the features and aspects of the present invention.

The following prior art is known to Applicant:

U.S. Pat. No. 888,186 to McAuley discloses a billiard table having a music box associated therewith whereby the first ball pocketed will set in operation the music box. Of course, this is different from the teachings of the present invention, which contemplates a scorekeeping system including both audio and visual input/output features.

U.S. Pat. No. 1,146,242 to Garaughty discloses a billiard table having pockets with switches contained therein designed to be closed by balls falling in the pockets. An indicating means is associated therewith to give indication when a circuit including all of the switches has been closed.

This is different from the teachings of the present invention, since the present invention includes a highly complex sophisticated system for keeping score in a billiard game.

U.S. Pat. No. 1,220,420 to Heffley discloses a device designed to be used to score a game of billiards including switches closed by balls entering pockets. The present invention differs form the teachings of this patent for reasons including the use of voice synthesization.

U.S. Pat. No. 3,468,535 to Obst discloses a device designed to be used to score any game including a counting mechanism activated by closing of contacts. The present invention differs from the teachings of this patent as being specific to a game of billiards and including voice synthesization as well as other features.

U.S. Pat. No. 4,097,855 to Salvo discloses an electronic tennis scoring system designed to be worn on the user and responsive to concurrent depressing of buttons by both players indicating who has won a particular point. The present invention differs from the teachings of this patent as being directed to the game of billiards and as automatically operating responsive to balls dropping in pockets.

U.S. Pat. No. 4,140,220 to Hazeltine, et al. discloses a color recognition system designed to be used to sort billiard balls based upon their respective colors. The present invention does not contemplate such operation. As such, this patent is believed to be of only general interest concerning the teachings of the present invention.

U.S. Pat. No. 4,531,187 to Uhland discloses a game monitoring apparatus designed to be used to monitor the play at gambling games. The device calculates score and odds in its operation and may generate alarm signals if errors are made during play.

The present invention differs from the teachings of this patent as using voice synthesis as well as being associated with a billiard game.

U.S. Pat. No. 4,567,461 to Honeckman, et al. discloses an electronic dart game scoreboard designed to be used in scoring a game of darts and including hit registration sensors as well as electronic means for voice input and synthesized voice output. The present invention differs from the teachings of Honeckman, et al. as disclosing a circuit designed to be associated with a billiard game, among other reasons.

U.S. Pat. No. 4,840,376 to Garret discloses a device designed to be used in association with a billiard table to play a game of poker using the billiard table. This is different from the teachings of the present invention, which contemplates merely scoring and monitoring a game of billiards not associated with a game of poker.

SUMMARY OF THE INVENTION

The present invention relates to an electronic voice and control system for billiards. The present invention includes the following interrelated aspects and features:

(a) In a first aspect, the inventive system is intended to be installed in association with a standard billiard table of the type having internal passageways designed to be used to return the billiard balls to a single storage area. The billiard table should have a special system for directing a cue ball to a separate location due to the smaller diameter of the cue ball.

(b) The inventive system includes sensors on each of the pockets of the billiard table which consist of normally open switches designed to be closed when a ball has entered a particular pocket. Player control switches are provided on the table so that when a player is about to take their turn, the appropriate player control switch is depressed so that the system knows which player is playing.

(c) A display device is provided to display various aspects of the playing of a game of billiards, including the player scores, indication of a "scratch", indication that the wrong ball has been sunk, indication of a good shot, and other desired indications (d) An audio speaker is mounted on or adjacent the billiard table to broadcast various voice messages and sound effects controlled by the circuitry of the present invention and responsive to various aspects of play.

As such, it is a first object of the present invention to provide an electronic voice and control system for billiards.

It is a yet further object of the present invention to provide such a system designed to be incorporated into a standard billiard table.

It is a yet further object of the present invention to provide such a device which may be selectively programmed through the interchangeability of erasable programmable read-only memory chips.

It is a still further object of the present invention to provide such a device having switching means for indicating to the device that one or the other player is playing.

These and other objects, aspects and features of the present invention will be better understood from the following detailed description of the preferred embodiment when read in conjunction with the appended drawing figures.

DESCRIPTION OF THE PREFERRED EMBODIMENT

Figure 1:
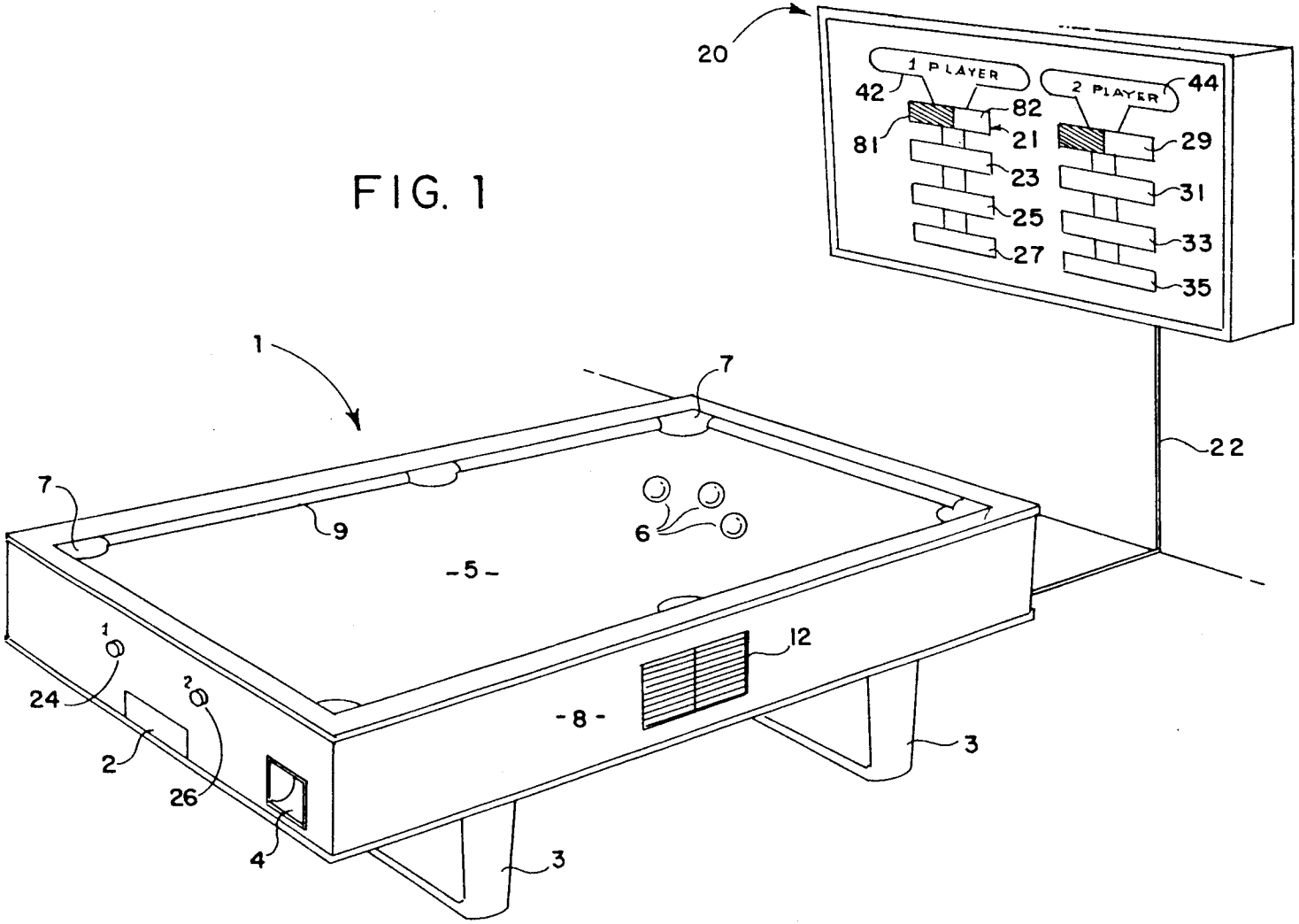
FIG. 1 shows a perspective view of a billiard table modified to incorporate therewith the present invention.

With reference, first, to FIG. 1, a billiard table is generally designated by the reference numeral 1 and is seen to include support legs 3, a playing surface 5 with pockets 7, a rail 9, as well as a chamber 2 designed to receive balls which have been shot into the pockets 7 and a receptacle 4 designed to receive the cue ball.

In a manner well known to those skilled in the art, a billiard table such as that which is depicted in FIG. 1 may be provided with a series of internal passageways (not shown) including ramps (not shown) to conduct billiard balls such as those designated by the reference numeral 6 from the pockets 7 to the receptacle 4. In a further aspect, as is known to those skilled in the art, the cue ball has a slightly smaller diameter than the diameter of the object balls numbered 1–15. Thus, a special series of ramps (not shown) are provided, including an opening (not shown) sized to only allow receipt of the cue ball and thereafter the ramps conduct the cue ball to the receptacle 4.

As seen in FIG. 1, the billiard table 1 has a side wall 8 into which is mounted a grill 12 designed to receive thereunder a speaker (not shown) in a recess formed in the wall 8. In a further aspect, a scoreboard 20 is provided including a column of indicators for each player. For player number 1, the indicators include a two-digit score display 21, an indicator 23 of a good shot, an indicator 25 to indicate that the wrong ball has been sunk, and an indicator 27 designed to indicate when a "scratch" has occurred. Of course, as is well known, a "scratch" consists of sinking the cue ball during play.

In a similar manner, a further column of indicators is provided for the second player, with this column including a two-digit score indicator 29, a good shot indicator 31, an indicator 33 to indicate that the wrong ball has been sunk, and a "scratch" indicator 35. The display 20 is electrically connected to various sensors and other aspects of the present invention, as will be described in greater detail hereinafter, by virtue of the electrical conductor 22.

With further reference to FIG. 1, switches 24 and 26 are provided so that the inventive system may be informed which player is at play.

Figure 2:
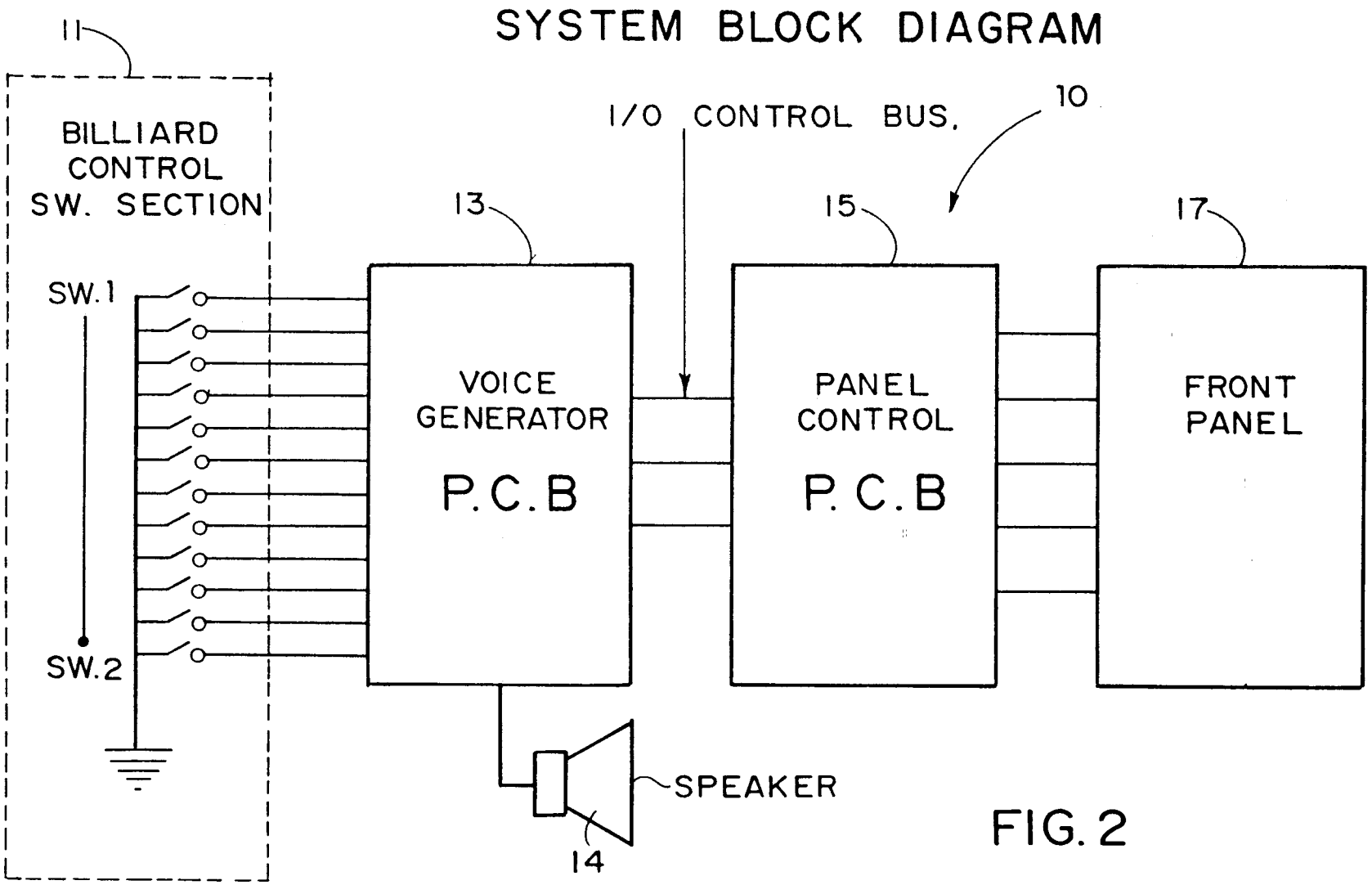
FIG. 2 shows a block diagram of the inventive system.

With reference now to FIG. 2, the inventive system is generally designated by the reference numeral 10 and is seen to be generally divided up into a number of sub-circuits. These sub-circuits consist of a billiard control switch section 11, a voice generator sub-circuit section 13, a panel control sub-circuit section 15, and a front panel display section 17. The speaker 14 illustrated in FIG. 2 is that which is hidden behind the grill 12 illustrated in FIG. 1.

Figure 3:
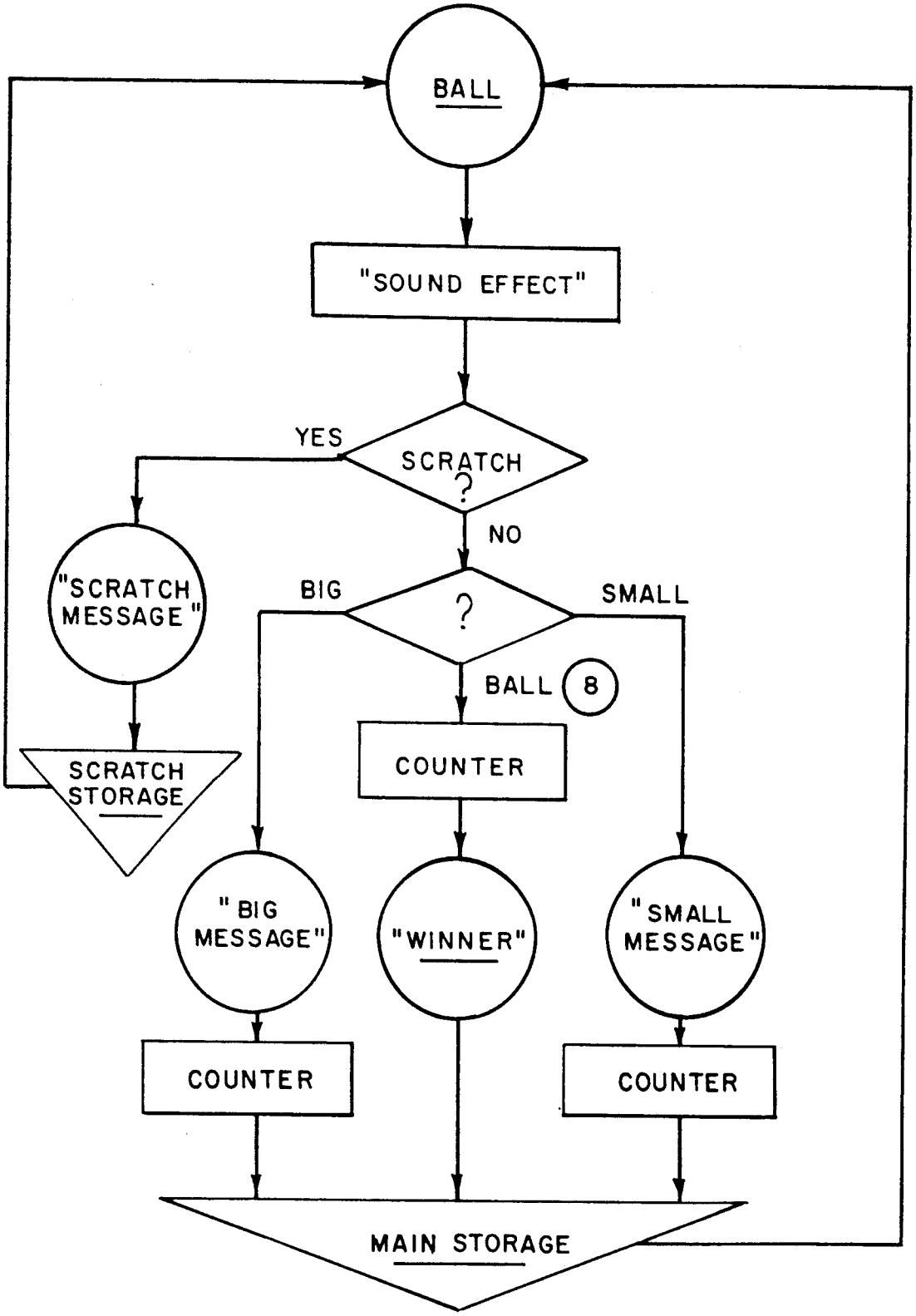
FIG. 3 shows a flow chart illustrating certain aspects of the operation of the inventive system.

FIG. 3 shows a system flow chart indicating some of the logic of the preprogramming of software incorporated in the teachings of the present invention. As shown in FIG. 3, the circuitry of the inventive system 10 is able to discriminate between sinking of the cue ball (a "scratch"), sinking of object balls, and, for example, sinking of the 8-ball. Responsive to the various events occurring, various indicators may be activated including sound effects, counter mechanisms to keep score, "scratch" indication and storage of indication of "scratches", etc.

Figures 4, 5, 6, 18:
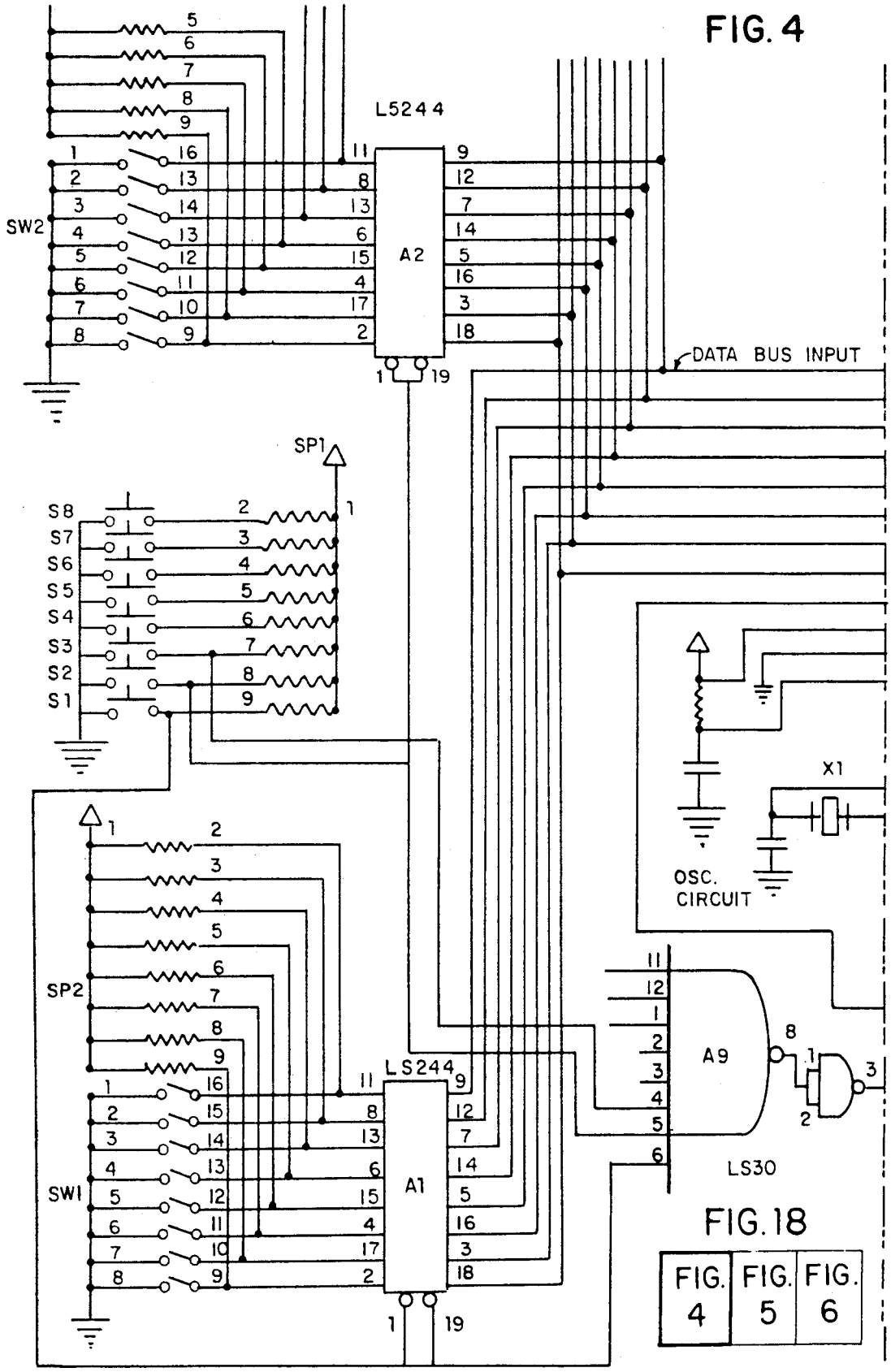
FIGS. 4, 5, 6, 7, 8 and 9, when combined together, show the voice board sub-circuit of the present invention.
FIG. 18 shows the manner in which FIG. 4 connects to FIGS. 5 and 6.
Figures 4, 5, 6, 19:
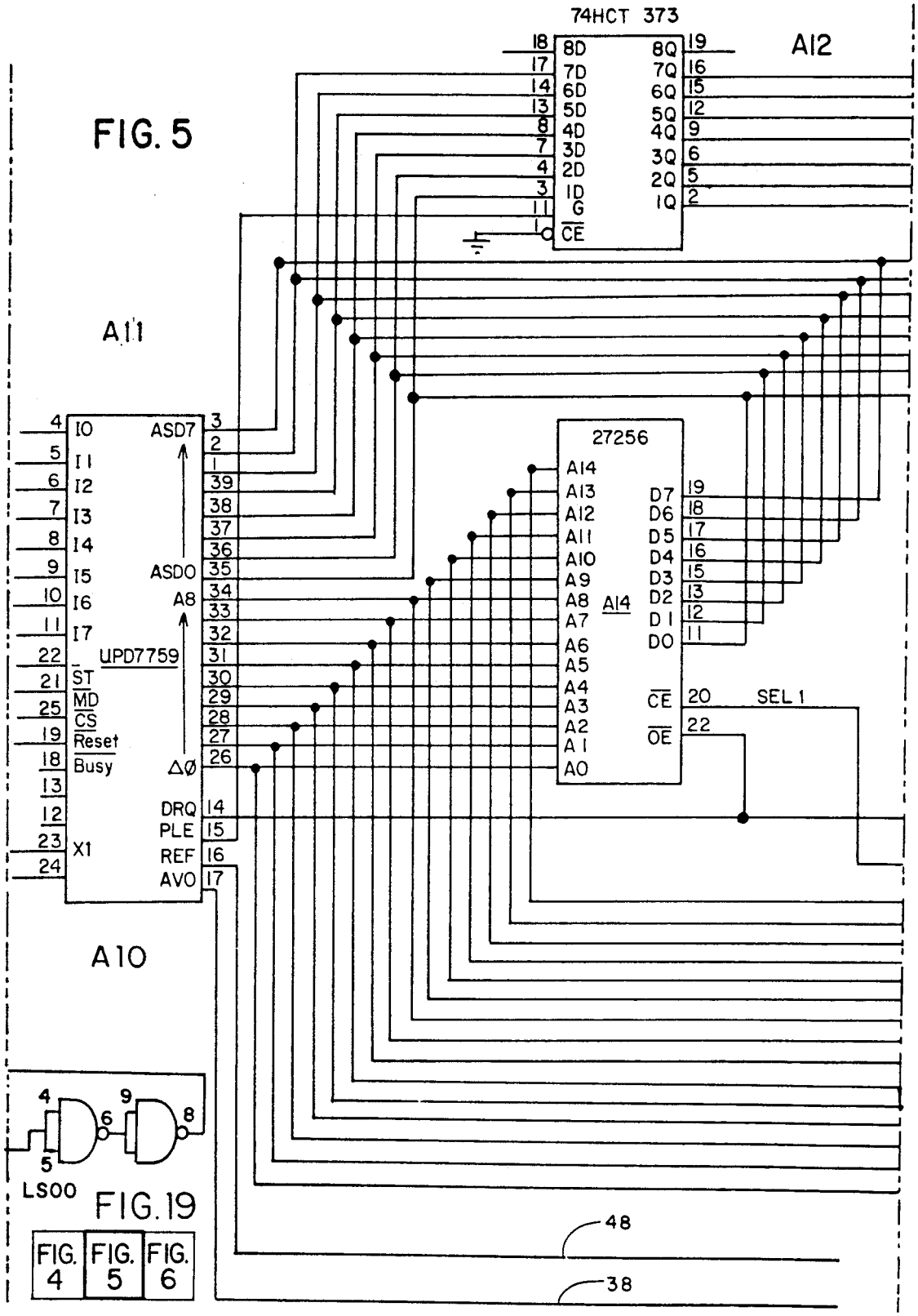
FIG. 19 shows the manner in which FIG. 5 connects to FIGS. 4 and 6.
Figures 6, 20:
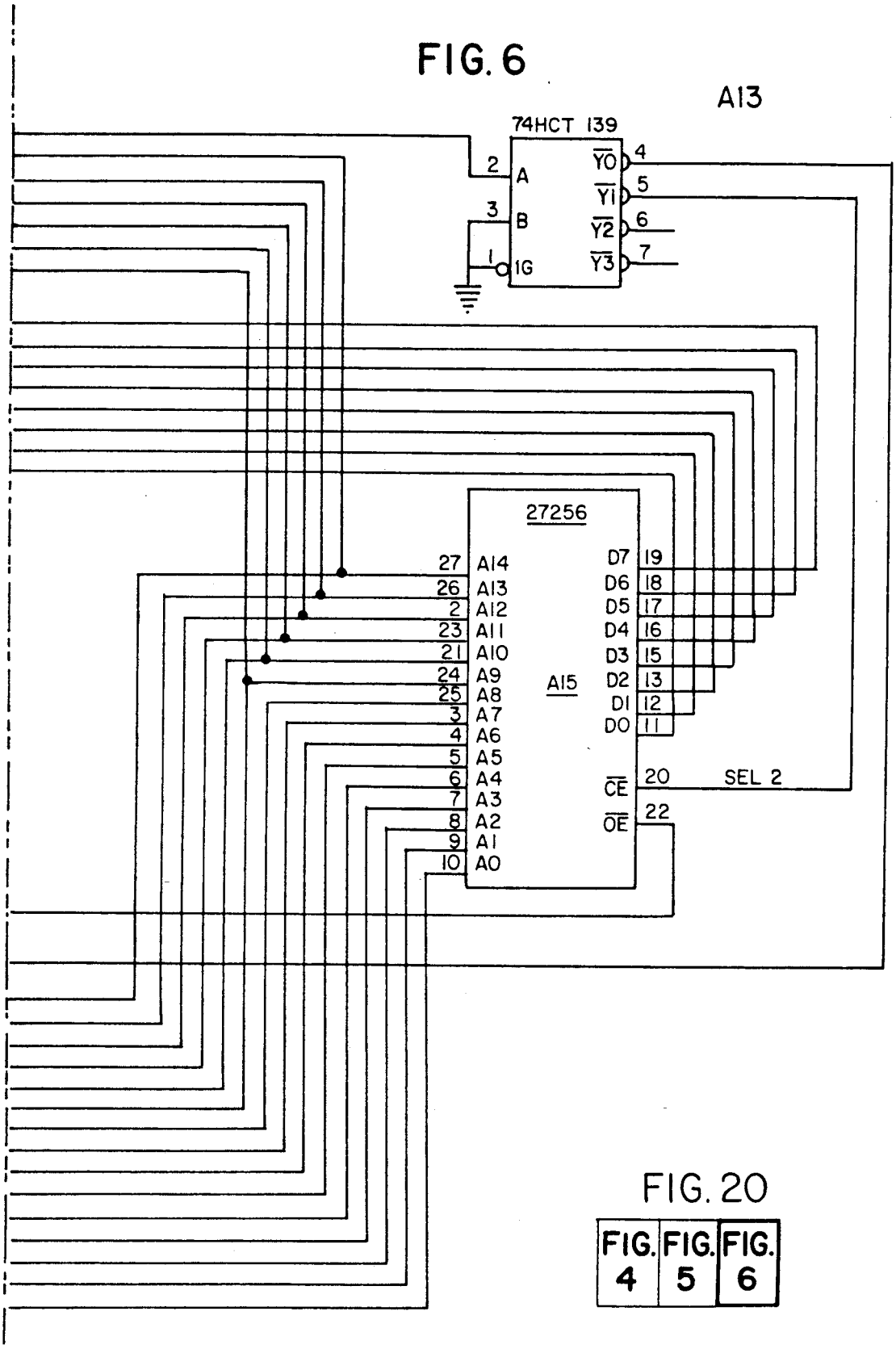
FIG. 20 shows the manner in which FIG. 6 connects to FIGS. 4 and 5.

Reference is now made to FIGS. 4–9 and 18–23 for a discussion of the voice board sub-circuitry of the inventive system 10. With reference, first, to FIG. 4, switches S1 through S8 are illustrated. Switches S1 through S6 consist of a switch mounted in each of the pockets 7 of the billiard table 1, which switches are normally opened and are closed responsive to sinking of a ball in a particular pocket. Thus, the inventive system may not only know when a ball has been sunk, but may also know into which pocket the ball has entered.

The switch labeled S7 in FIG. 4 is a normally open switch contained within the special passage described above which may only receive the cue ball due to its reduced diameter as compared to the object balls 6. When a "scratch" has occurred, when the cue ball enters the special passage, the "scratch" switch S7 is closed, thereby indicating a "scratch". The switch S8 consists of a switch which may be activated, for example, responsive to sensing of a magnetic field. In the referred embodiment of the present invention, the object ball, known as the "8-ball", may be specially coated with a magnetic material designed to be sensed by the switch S8. Thus, when the 8-ball has been sunk, when the switch S8 senses the magnetic field, indication will be given that the 8-ball has been sunk. Since the inventive system 10 is programmed to keep track of the number of balls which have been sunk, for example, in playing the 8-ball, the system will know that each player has to sink seven balls before that player may sink the 8-ball. Thus, if a player sinks the 8-ball as that player's fifth ball, the system will know and will indicate that the player has improperly sunk the 8-ball, thus losing the game.

FIGS. 5 and 6 illustrate the speech synthesis subsection of the inventive system 10. The chip labeled All consists of a speech synthesis and system controller chip. The chips labeled A14 and A15 are EPROMs, which may be preprogrammed with speech synthesis software. Thus, the present invention may be preprogrammed so that speech synthesis indicating good shots, winning of the game and the like, may be provided in any language and/or dialect.

Figures 7, 21:
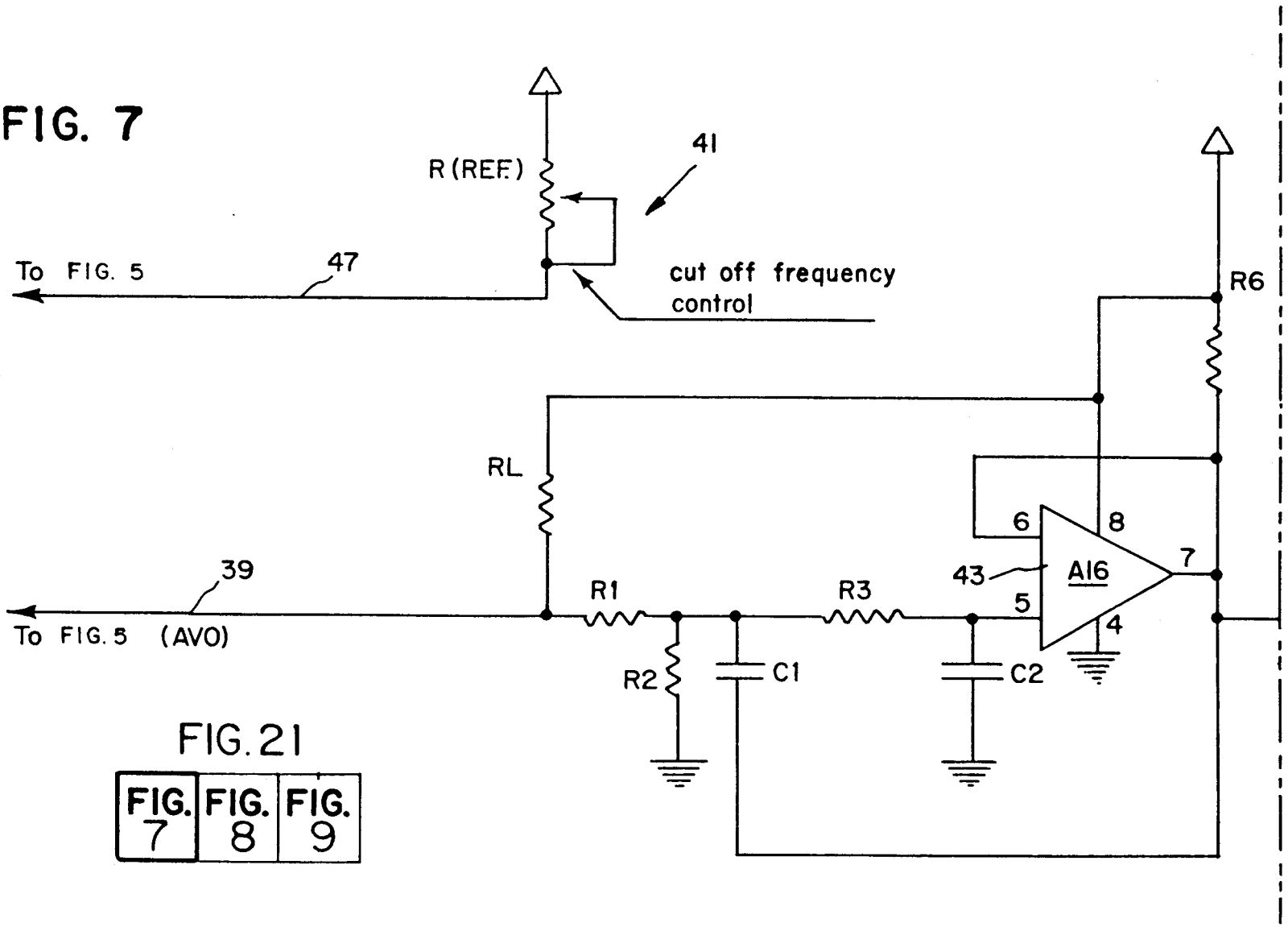
FIG. 21 shows the manner in which FIG. 7 connects to FIGS. 8 and 9.
Figures 8, 22:
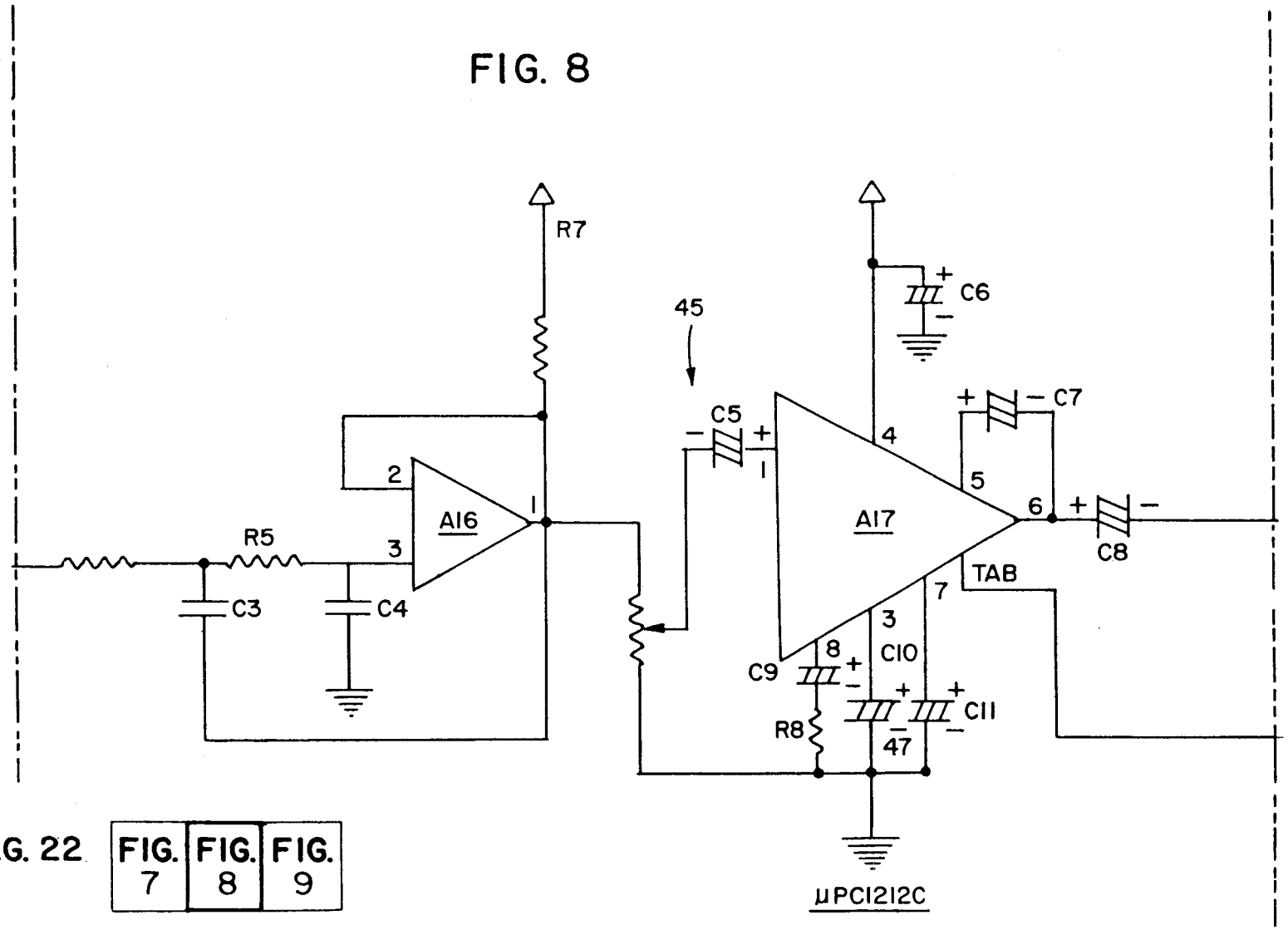
FIG. 22 shows the manner in which FIG. 8 connects to FIGS. 7 and 9.
Figures 9, 23:
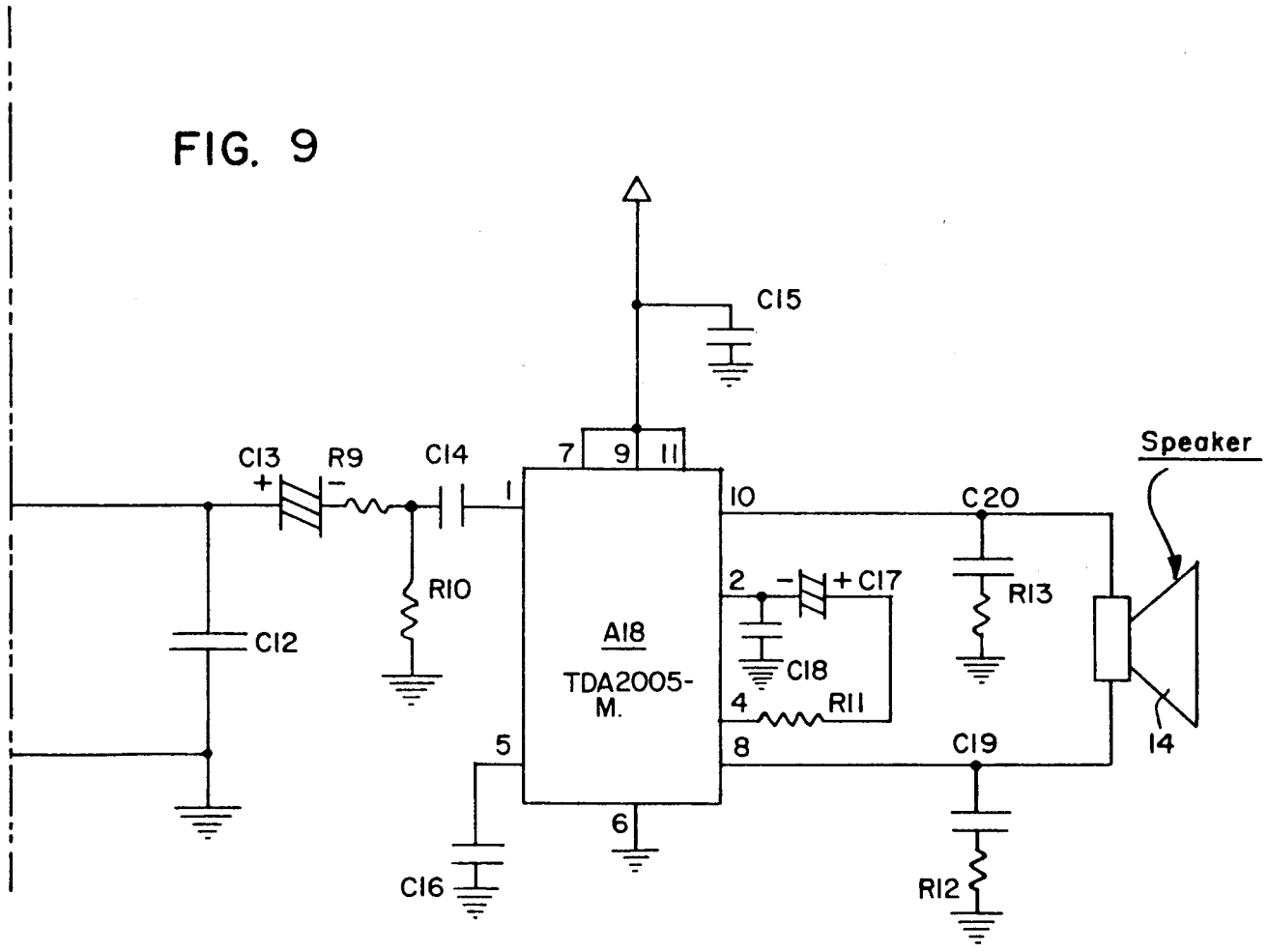
FIG. 23 shows the manner in which FIG. 9 connects to FIGS. 7 and 8.

FIG. 7 shows a cut-off frequency control 41 as well as a dual operational amp 43. FIGS. 8 and 9 show a sub-circuit wherein audio volume is controlled. This area is generally designated by the reference numeral 45.

With reference to FIGS. 8 and 9, the amplifiers A17 and A18 are, in the preferred embodiment, integrated circuit power amplifiers which may be rated in the range of 20 Watts. The speaker 14 is provided to broadcast amplified signals.

In a further aspect, with reference back to FIGS. 7 and 8, these figures depict a low pass filter circuit designed to filter signals in a manner well known to those skilled in the art. The audio input 39 interconnects to the conductor 38 illustrated in FIG. 5. Furthermore, the conductor 47 which consists of an input to the cut-off frequency control 41 interconnects with the conductor 48 illustrated in FIGS. 5 and 6. The conductor 48 is interconnected with the reference terminal of the speech synthesis and system controller A11.

Figures 10, 24:
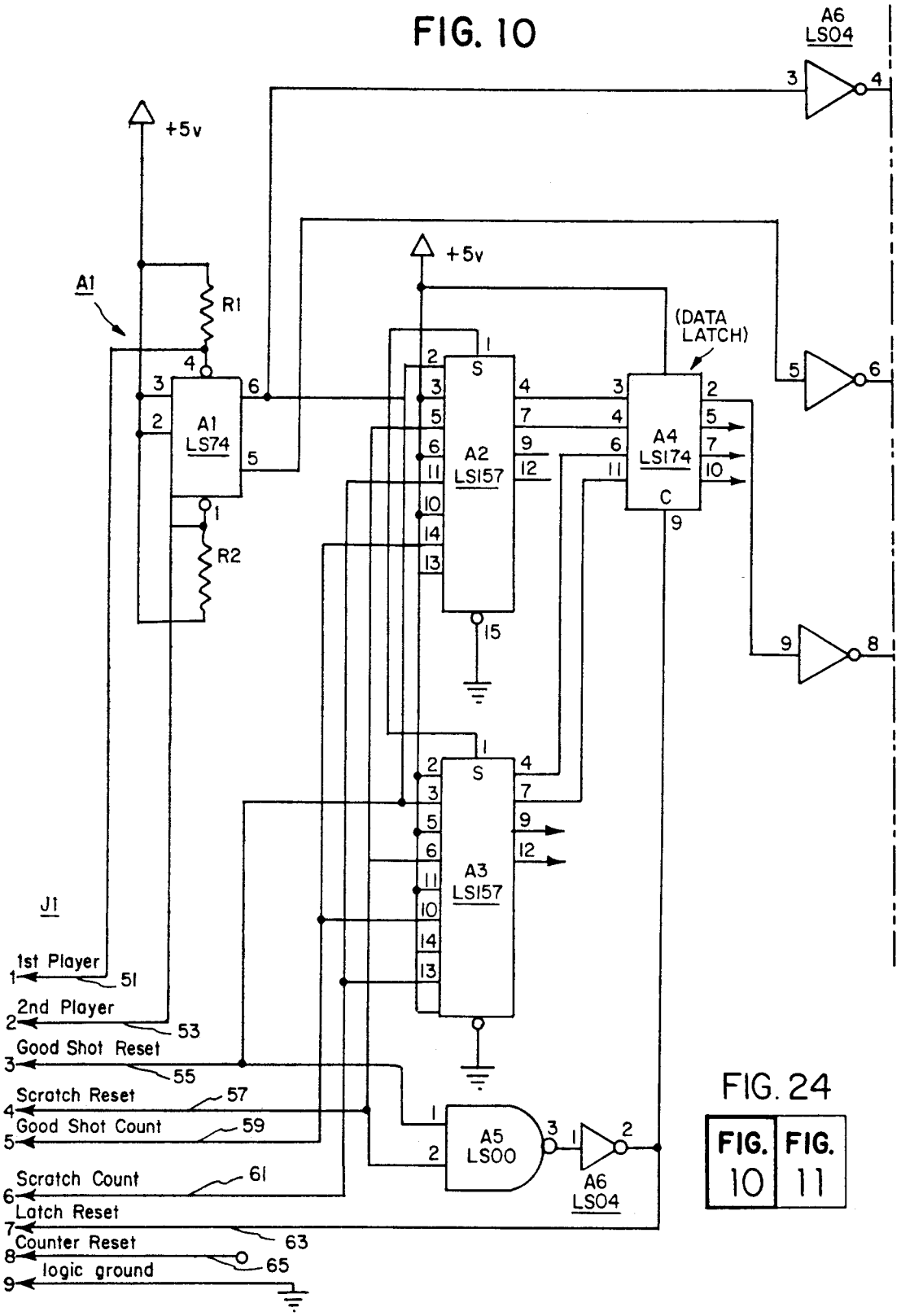
FIGS. 10 and 11, when combined together, show a portion of the panel control board sub-circuit of the present invention.
FIG. 24 shows the manner in which FIG. 10 connects to FIG. 11.

With reference to FIGS. 10, 11, 24 and 25, a portion of the panel control board sub-circuit is shown. With particular reference to FIG. 10, the conductor 51 is connected to the switch 24 while the conductor 53 is connected to the switch 26. The conductors 55, 57, 59, 61, 63 and 65 are appropriately labeled in FIG. 10 and connect to automatic devices for counting or resetting as indicated.

Thus, the conductor 55 connects to a mechanism (not shown) designed to reset the good shot indicator 23 or 31 illustrated in FIG. 1. Similarly, the conductor 57 is connected to a mechanism (not shown) designed to reset the indicator 27 or 35 indicating a "scratch". The conductors 59 and 61 connect to the indicators illustrated on the display 20 for counting good shots and "scratches". The conductor 63 resets the display 20 when a new game is to be played, while the counter reset 65 specifically resets the counters 21 and 29.

In FIG. 10, the chips designated by the identifiers A2 and A3 are A/B selectors, while the chip identified by the identifier A4 is a data latch. A5 constitutes a portion of the reset circuit which, as shown, is connected with the conductors 55, 57.

Figures 11, 25:
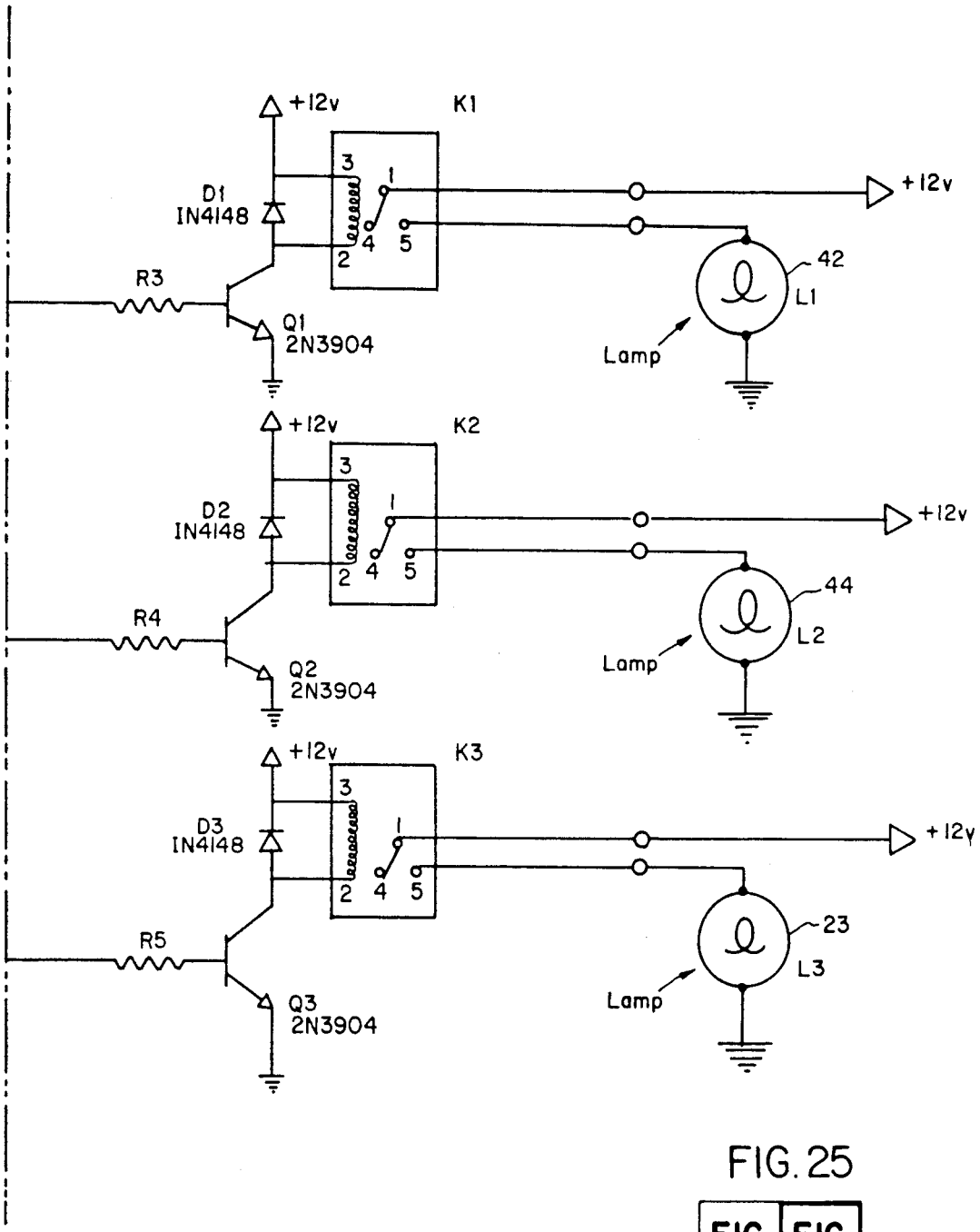
FIG. 25 shows the manner in which FIG. 11 connects to FIG. 10.

FIG. 11, which interconnects with FIG. 10 as shown in FIGS. 24 and 25, shows illumination circuits for the indicators 42, 44 shown on the display 20. When the switch 24 is closed indicating that the first player is to play, the indicator 42 is lit. Correspondingly, when the switch 26 is closed, the indicator 44 is lit. FIG. 11 also shows the good shot indicator 23 and associated circuitry for activating same.

Figure 12:
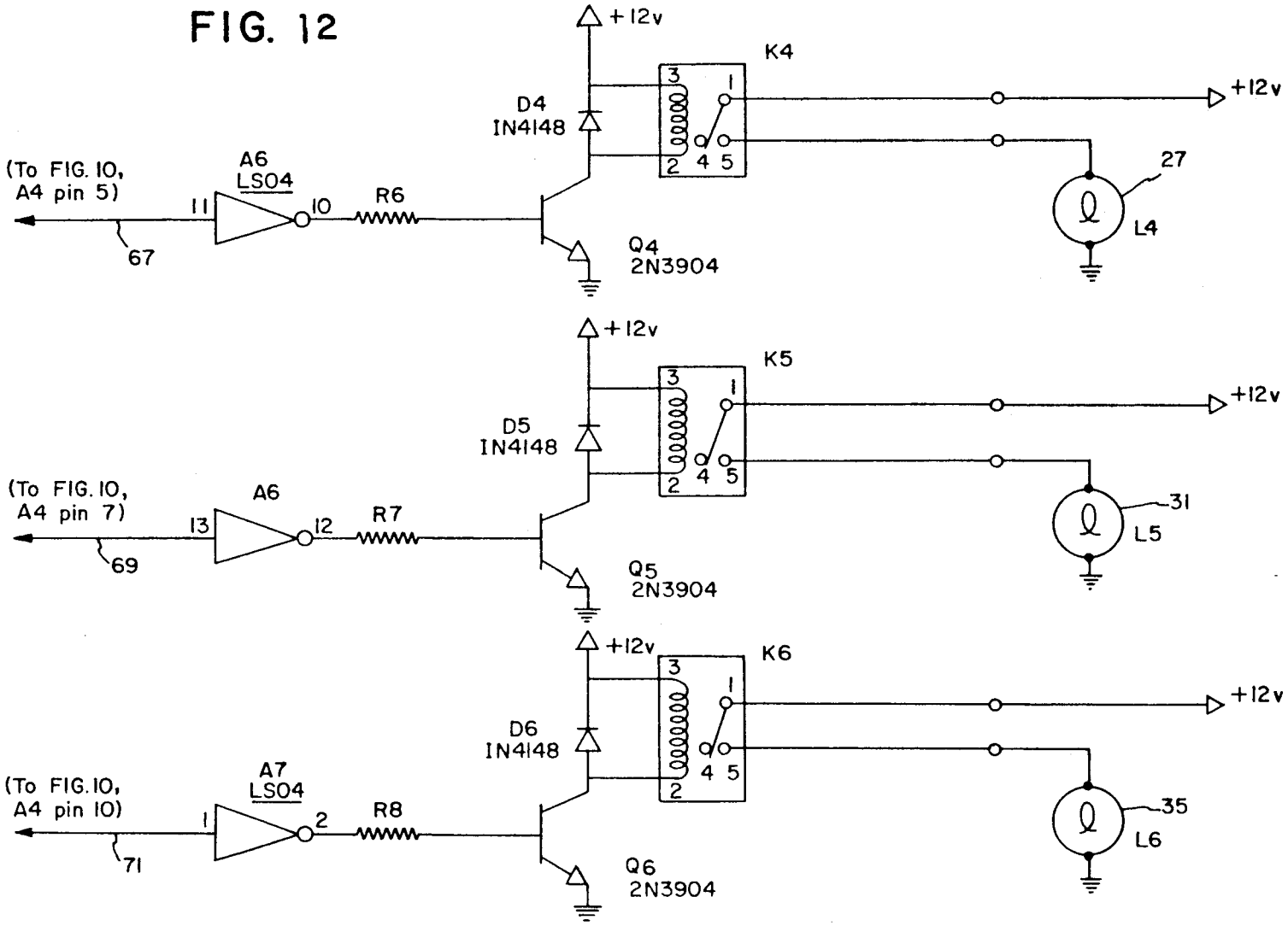
FIG. 12 shows another portion of the panel control board sub-circuit illustrated in FIGS. 10–11.

FIG. 12 shows the "scratch" indicator 27, the good shot indicator 31, and the "scratch" indicator 35. On the left-hand side of the figure, conductors 67, 69 and 71 are illustrated along with instructions showing their location of interconnection into the data latch A4 illustrated in FIG. 10.

Figures 13, 14, 17:
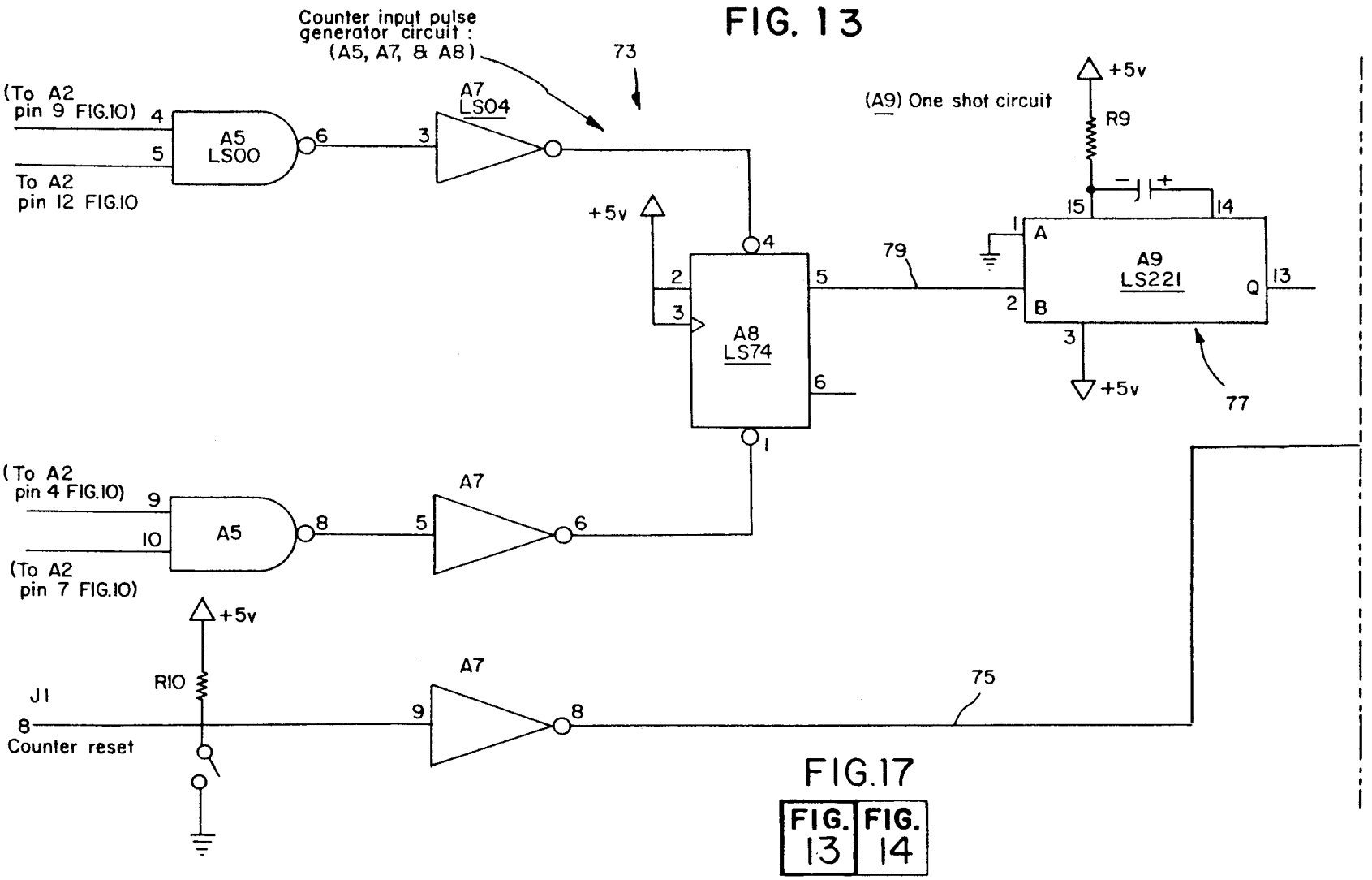
FIGS. 13 and 14, when combined together, show a further aspect of the panel control board sub-circuit illustrated in FIGS. 10–11 and 12.
FIG. 17 shows the manner in which FIG. 13 connects to FIG. 14.
Figures 14, 28:
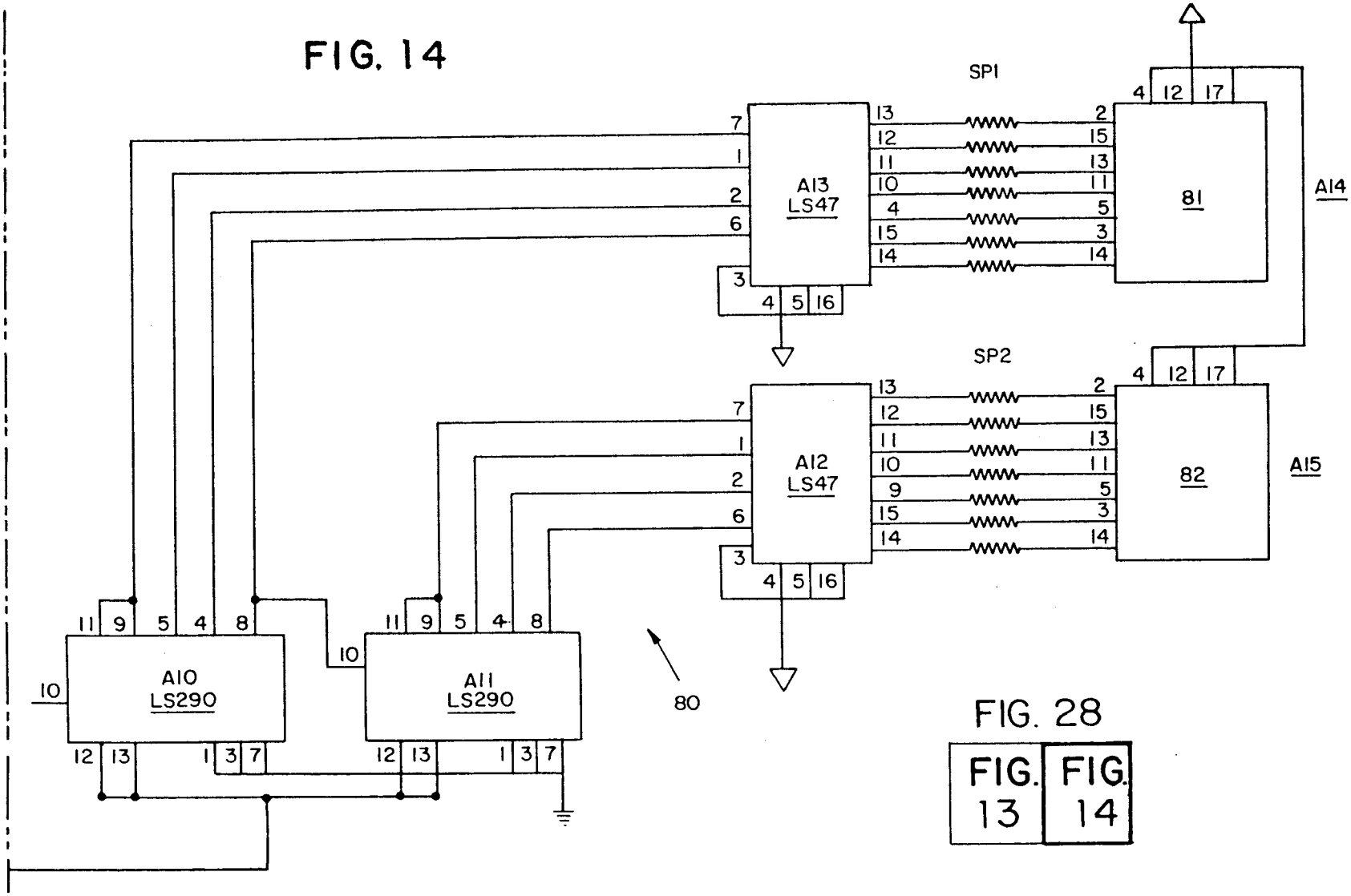
FIG. 28 shows the manner in which FIG. 14 connects to FIG. 13.

With reference to FIGS. 13–17 and 26–28, further aspects of the panel control board sub-circuit are shown. FIG. 13 shows the counter input pulse generator circuit 73 and the left-hand side of FIG. 13 illustrates the locations of interconnection of the various components into the A/B selector A2 illustrated in FIG. 10.

FIG. 13 also shows the counter reset conductor 75 which connects with the conductor 65 illustrated in FIG. 10. The one shot circuit 77 is interconnected into the counter impulse generator circuit via the conductor 79.

With reference to FIG. 14, the counter circuit 80 for the counter 21 for the first player is seen to include counter circuits A10, A11, A12 and A13, as well as seven segment counter indicators 81, 82, also illustrated in FIG. 1.

Figures 15, 16, 27:
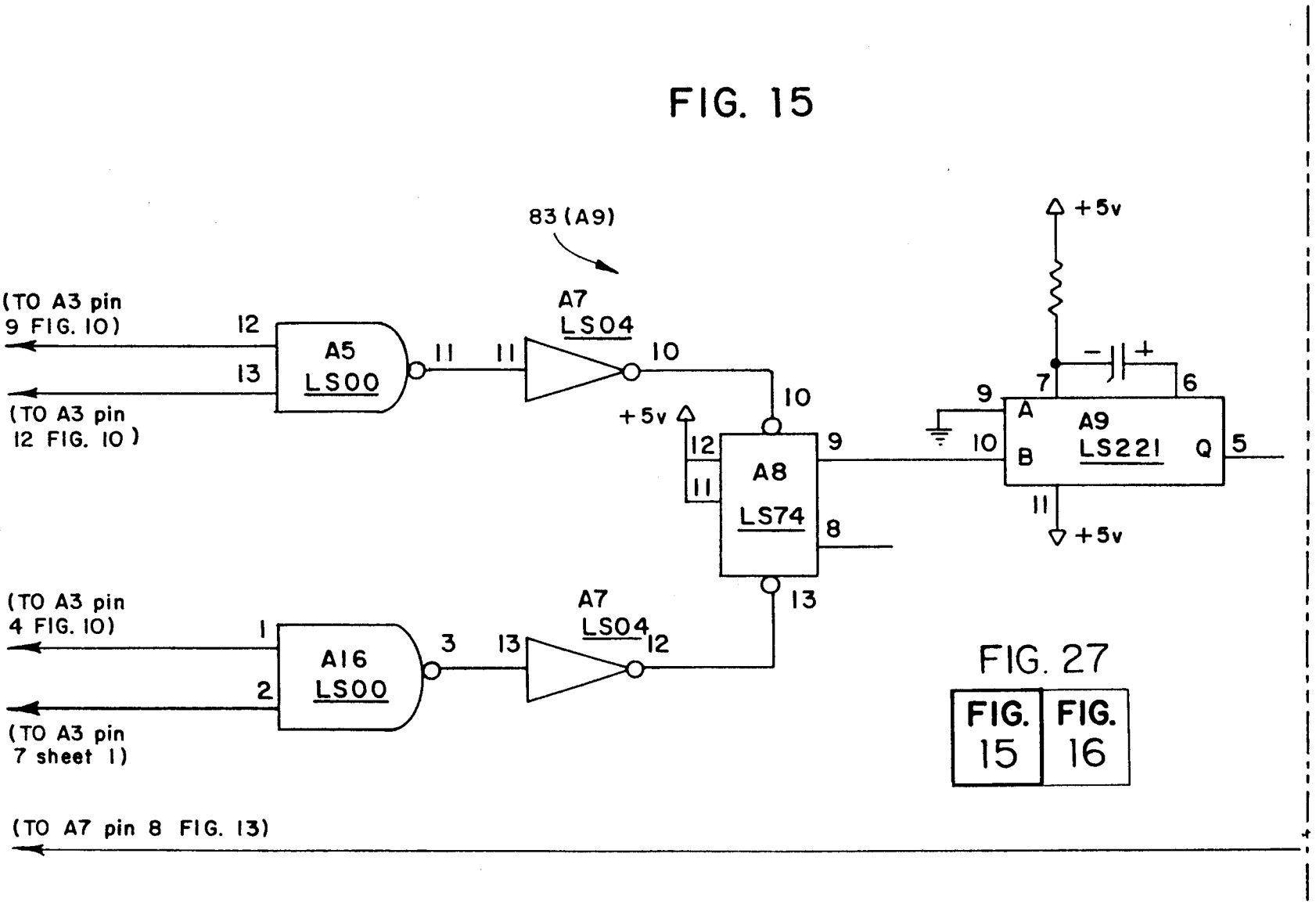
FIGS. 15 and 16, when combined together, show a further aspect of the panel control board sub-circuit illustrated in FIGS. 10–11, 12, 13 and 14.
FIG. 27 shows the manner in which FIG. 15 connects to FIG. 16.
Figures 16, 26:
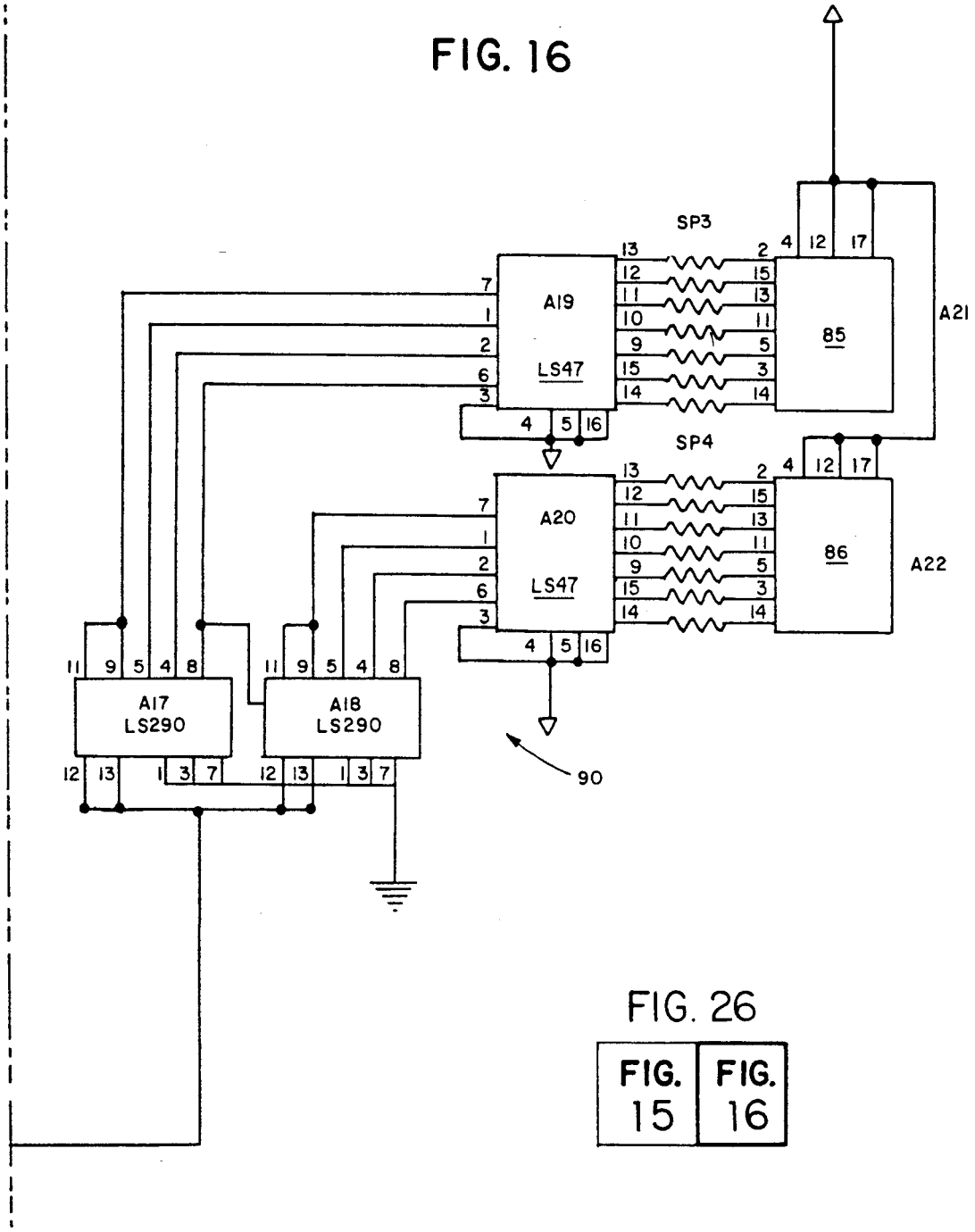
FIG. 26 shows the manner in which FIG. 16 connects to FIG. 15.

With reference to FIGS. 15–17 and 26–28, the analogous circuitry for the indicator 29 shown on the display board 20 of FIG. 1 is also shown. This circuit includes the counter impulse generator circuit 83 with the left-hand side of FIG. 15 showing the interconnection of the various conductors into the A/B selector A3 illustrated in FIG. 10, as well as to pin 8 of circuit element A7 illustrated in FIG. 13.

FIG. 16 shows the counter circuits A17, A18, A19 and A20, as well as the seven segment counter indicators 85 and 86. The counter circuits A17, A18, A19 and A20 are collectively referred to by reference numeral 90.

As such, from the above description, the particular manner of operation of the present invention should be understood. When two players are ready to play the game, the system is activated by closure of an activation switch (not shown). With all of the balls 6 placed on the table when a player is ready to play, the player closes the switch 24 or 26, depending upon which player, and begins playing. If a "scratch" occurs during the course of the game, such is indicated by the "scratch" indicator 27 or 35 and shortly thereafter, the "scratch" indicator 27 or 35 is appropriately reset.

As balls are sunk, the switches contained within the pockets 7 sense such and the scores of the respective players are tallied and displayed by the indicators 21, 29. As each player takes his or her turn, the respective players close their switch 24 or 26 so that the system 10 is given indication as to which player is playing.

The circuit is designed such that responsive to sinking of balls, "scratching", winning the game and other situations, voice synthesis is activated as illustrated in FIGS. 4–9 and 18–23 so that audio output on the speaker 14 may be used to create a more entertaining game.

Thus, closures of the switches S1–S8 illustrated in FIG. 4 is sensed by the voice board control sub-circuit to activate the speech synthesis and system controller All to thereby cause retrieval of preprogrammed words, phrases or sentences from the EPROMs A14, A15, whereupon the appropriate signals are transmitted by the conductors 38, 48 and via the low pass filter circuit 41, the audio volume control 45, and the amplifiers A17 and A18 to the speaker 14, whereupon, for example, a voice will be heard to say: "good shot!" after a shot has been successfully completed. At the conclusion of the game, a similar sequence of signals is transmitted to result in the speaker 14 broadcasting a phrase such as, for example, "Congratulations on winning the game!".

Of course, the inventive system 10 may be utilized to play other games besides "8-ball". For example, the inventive game may be used in playing the game "9-ball", wherein billiard balls 1 through 9 are placed on the table and must be sunk successively. In this mode of operation, each ball may be coated with a magnetic material so that each ball has a differing level of magnetic intensity. A sensor (not shown) may be provided to sense the differing levels of magnetic intensity so as to monitor the game in such a manner that indication of sinking of balls out of sequence results in indication that that player has lost the game. Similarly, indication that all balls have been sunk in sequence results in indication that a player has won the game through visual indication on the display 20 as well as audio indication via the speaker 14.

The use of EPROMs A14 and A15, as stated above, enables the user of the game to reprogram the voice synthesis for different languages and dialects as desired.

As such, an invention has been disclosed in terms of a preferred embodiment thereof which fulfills each and every one of the objects of the invention as set forth hereinabove and provides a new and interesting system designed to be incorporated into a billiard table and to enhance the playing of a game of billiards.

Of course, various changes, modifications and alterations in the teachings of the present invention may be contemplated by those skilled in the art without departing from the intended spirit and scope thereof. As such, it is intended that the present invention only be limited by the term of the appended claims.

I claim:

1. In a billiard table having a playing surface, a plurality of pockets adjacent said playing surface, conveyance system means for conveying object balls from said pockets to a storage area, and further conveyance system means for conveying a cue ball from said pockets to a cue ball storage area, the improvement comprising a control and scoring system comprising:

(a) a single display including all player indicators for indicating which player is playing, scoring indicator means for all players for displaying a score and "scratch" indicator means for indicating (1) when a "scratch" has occurred and (2) which player has "scratched";

(b) switch means in each pocket closeable when a ball has entered a pocket, each object ball being coated with a magnetic material in a manner such that each object ball has a unique level of magnetic intensity different from a level of magnetic intensity of any other object ball;

(c) switch means in said further conveyance system means closeable when a cue ball is being conveyed thereby;

(d) player switches on said table manually closeable by a player before commencing a turn; and (e) control means for controlling said system and including:

(i) first means for receiving signals indicating closure of a player switch and sending signals to activate an appropriate player indicator on said display;

(ii) second means for receiving signals indicating closure of said pocket switch means and sending signals to advance an appropriate said scoring indicator means on said display;

(iii) third means for receiving signals indicating closure of said further conveyance system switch means and sending signals to activate an appropriate said "scratch" indicator means on said display;

(f) voice synthesis means activatable by said control means responsive to receipt of preselected signals by said control means for broadcasting audible voice signals; and (g) magnetic sensing means for sensing the magnetic intensity of each ball which has entered a pocket and identifying each such ball by its said unique level of magnetic intensity and, responsive to such sensing and identifying, causing activation of an indicator on said display.

2. The invention of claim 1, wherein said player indicators each comprise a light.

3. The invention of claim 1, wherein each said scoring indicator means comprises a digital scoring display.

4. The invention of claim 3, wherein said digital scoring display comprises a two-digit display.

5. The invention of claim 1, wherein each said "scratch" indicator means comprises a light.

6. The invention of claim 1, wherein said preselected signals comprise signals activated responsive to closure of a player switch, closure of a pocket switch means, or closure of said further conveyance system switch means.

7. The invention of claim 1, wherein said voice synthesis means includes at least one EPROM programmed for causing broadcast of voice signals in a particular dialect.

* * * * *